US006435645B1

(12) United States Patent
Falinski

(10) Patent No.: US 6,435,645 B1
(45) Date of Patent: Aug. 20, 2002

(54) CHARGED DROPLET POSITION DETERMINING APPARATUS

(75) Inventor: Marian Stanislaw Falinski, Cambridge (GB)

(73) Assignee: Marconi Data Systems Inc., Wood Dale, IL (US)

( * ) Notice: Subject to any disclaimer, the term of this patent is extended or adjusted under 35 U.S.C. 154(b) by 0 days.

(21) Appl. No.: 09/555,749

(22) PCT Filed: May 22, 1997

(86) PCT No.: PCT/GB97/01406

§ 371 (c)(1),
(2), (4) Date: Oct. 20, 2000

(87) PCT Pub. No.: WO97/44193

PCT Pub. Date: Nov. 27, 1997

(30) Foreign Application Priority Data

May 23, 1996 (GB) ..... 9610796

(51) Int. Cl.[7] ..... B41J 2/01
(52) U.S. Cl. ..... 347/19; 347/81
(58) Field of Search ..... 347/19, 81

(56) References Cited

U.S. PATENT DOCUMENTS 3,886,564 A 5/1975 Naylor, III et al. ..... 347/81
3,977,010 A * 8/1976 Erickson et al. ..... 347/81
4,121,223 A * 10/1978 Omori et al. ..... 347/81
4,434,428 A 2/1984 Horike et al. ..... 347/81
5,160,939 A 11/1992 Bajeux et al. ..... 347/78

* cited by examiner

*Primary Examiner*—Craig A. Hallacher
(74) *Attorney, Agent, or Firm*—Piper Rudnick

(57) ABSTRACT

An apparatus for determining the time at which a charged droplet is at a predetermined physical position comprising: first and second electrodes (1, 3) past which said droplet passes in use of said apparatus, said droplet inducing a charge on each said electrode (1, 3) as it passes; and circuitry (5, 7, 9) responsive to the charges induced on the first and second electrodes (1, 3) for determining the time at which said droplet is at said predetermined physical position midway between said electrodes (1, 3). An apparatus for measuring the velocity of a charged ink droplet generated by an ink jet printing system comprising: first and second spaced pairs of electrodes (23, 25, 27, 29) past which said droplet passes in use of said apparatus, said droplet inducing a charge on each said electrode (23, 25, 27, 29) of the pairs as it passes, and circuitry (35, 41, 43) responsive to the charges induced on the electrodes (23, 25, 27, 29) for determining the time at which said droplet is midway between the first pair of electrodes (23, 25) and the time at which the droplet is midway between the second pair of electrodes (27, 29), the velocity measurement being provided by dividing the distance between these two midway points by the time between the times at which the droplet is at these two midway points.

7 Claims, 1 Drawing Sheet

CHARGED DROPLET POSITION DETERMINING APPARATUS

TECHNICAL FIELD OF THE INVENTION

This invention relates to an apparatus for determining the time at which a charged droplet is at a predetermined physical position. The invention finds application in the measurement of the velocity of ink droplets generated by ink jet printing systems.

BACKGROUND

U.S. Pat. No. 4,417,256, discloses an apparatus comprising an electrode past which the charged droplet passes in use of the apparatus. Circuitry responsive to the charge induced on the electrode by the passing droplet, determines the time at which the droplet is in the neighbourhood of the electrode.

The apparatus of U.S. Pat. No. 4,417,256 does not precisely correlate the position of the droplet with the time at which the droplet is at that specific position. In particular it is not possible to say quite what point on the current waveform which arises due to the charge induced on the electrode, corresponds to the time at which the droplet is at a specific physical position in space with respect to the electrode.

SUMMARY OF THE INVENTION

According to a first aspect of the present invention there is provided an apparatus for determining the time at which a charged droplet is at a predetermined physical position comprising: first and second electrodes past which said droplet passes in use of said apparatus, said droplet inducing a charge on each said electrode as it passes; and circuitry responsive to the charges induced on the first and second electrodes for determining the time at which said droplet is at said predetermined physical position midway between said electrodes.

Preferably, the circuitry comprises: a differential amplifier, each of said first and second electrodes being connected to a respective one of the inputs to the differential amplifier; and a zero crossing detector for detecting the zero crossing between adjacent pulses of opposite sign output by said differential amplifier in response to the charges induced on the electrodes by the passing charged droplet.

According to a second aspect of the present invention there is provided an apparatus for measuring the velocity of a charged ink droplet generated by an ink jet printing system comprising: first and second spaced pairs of electrodes past which said droplet passes in use of said apparatus, said droplet inducing a charge on each said electrode of the pairs as it passes; and circuitry responsive to the charges induced on the electrodes for determining the time at which said droplet is midway between the first pair of electrodes and the time at which the droplet is midway between the second pair of electrodes, the velocity measurement being provided by dividing the distance between these two midway points by the time between the times at which the droplet is at these two midway points.

Preferably, said circuitry comprises: a differential amplifier, the first electrode of each pair passed by the droplet being connected to one input of the differential amplifier, the second electrode of each pair passed by the droplet being connected to the other input of the amplifier; and a zero crossing detector for detecting the zero crossing between adjacent pulses of opposite sign output by the amplifier in response to the charges induced on the pairs of electrodes by the passing charged droplet.

BRIEF DESCRIPTION OF THE DRAWINGS

An apparatus for determining the time at which a charged droplet is at a predetermined physical position will now be described, by way of example, with reference to FIG. 1 of the accompanying drawings which is a diagrammatic illustration of the apparatus. There will also be described, with reference to FIG. 2 of the drawings, the use of the present invention in the measurement of the velocity of a charged ink droplet generated by an ink jet printing system.

DESCRIPTION OF THE PREFERRED EMBODIMENTS

Figure 1:
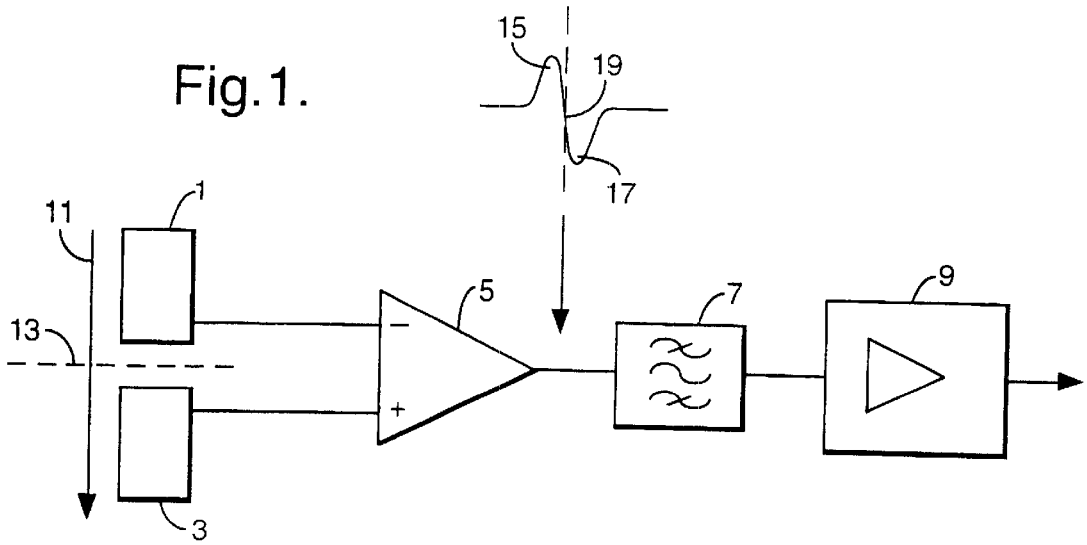

Referring to FIG. 1, the apparatus comprises first and second electrodes 1, 3, a differential amplifier 5, a noise filter 7, and a gated negative zero crossing detector 9. The charged droplet follows path 11 past electrodes 1, 3. The apparatus determines the time at which the droplet intersects the line 13 midway between electrodes 1, 3.

As the negatively charged droplet passes first electrode 1 it will induce a negative voltage on the inverting input of differential amplifier 5, producing a positive voltage pulse 15 at the output of amplifier 5. When the droplet passes second electrode 3 it will induce a negative voltage on the non-inverting input of amplifier 5, producing a negative voltage pulse 17 at the output of amplifier 5. The zero crossing point 19 between pulses 15, 17 of the output of amplifier 5 corresponds to the time at which the droplet intersects line 13, i.e. is midway between electrodes 1, 3. Thus, at the time of zero crossing it is known that the droplet is positioned midway between electrodes 1, 3 resulting in reproduceable measurement.

The time of zero crossing is determined by gated negative zero crossing detector 9, following filtering of the output of amplifier 5 by noise filter 7. Prior to receipt of pulses 15, 17 the gate of detector 9 is switched off. This gate is opened by the receipt of pulse 15 which is above the positive threshold of the gate. At the instant of zero crossing, detector 9 generates a pulse and closes its gate. This pulse is supplied to a counter timer (not shown). The leading edge of the pulse corresponds to the time at which the droplet is midway between electrodes 1, 3.

It will be appreciated that the above described use of differential amplifier 5 in combination with symmetrical electrodes 1, 3 is particularly advantageous, since it results in the cancellation of noise. This is especially useful in circumstances where the charge induced by the passing charged droplet is very small. This would be the case where the charged droplet was a charged ink droplet generated by an ink jet printing system.

The distance between electrodes 1, 3 and the width thereof is chosen to obtain as brief as possible a transition from the positive peak of pulse 15 to the negative peak of pulse 17, and simultaneously to obtain the maximum possible signal amplitude. Electrodes 1, 3 must not be so far apart that there is a flat plateau at zero between pulses 15, 17. Electrodes 1, 3 must not be so close together that pulses 15, 17 partially cancel one another.

Figure 2:
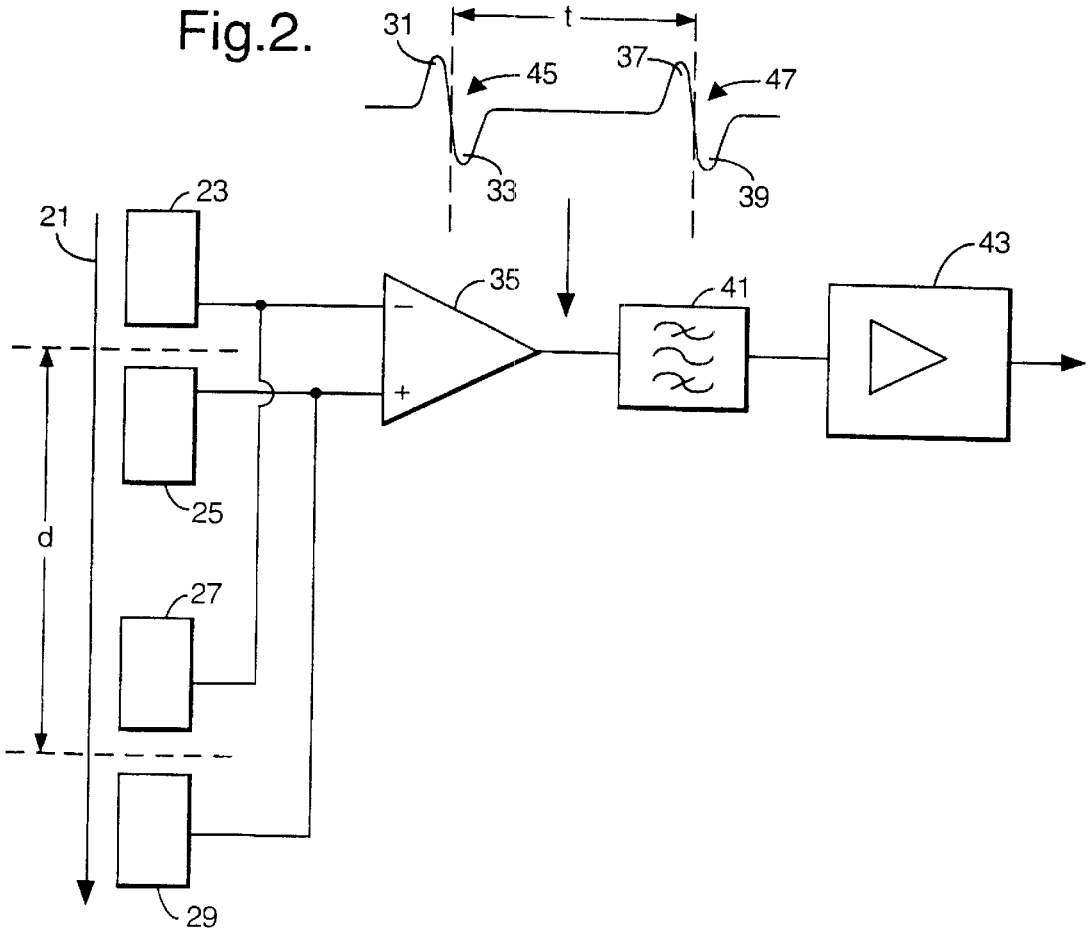

Referring to FIG. 2, the charged ink droplet follows path 21 past first pair of electrodes 23, 25, then past second pair of electrodes 27, 29. The charges induced on electrodes 23, 25 give rise to pulses 31, 33 at the output of differential amplifier 35. The charges induced on electrodes 27, 29 give rise to pulses 37, 39 at the output of amplifier 35. Following filtering by noise filter 41, gated negative zero crossing detector 43 detects the zero crossing points 45 and 47 between pulses 31, 33 and 37, 39 respectively. The time t between zero crossing points 45, 47 is the time it has taken for the droplet to travel the distance d from midway between the first pair of electrodes 23, 25 to midway between the second pair of electrodes 27, 29. Thus, the velocity of the ink droplet equals d/t.

It is to be realised that the present invention may be used in the so-called phasing process which takes place in the use of ink jet printing systems. This process requires a determination of whether an ink droplet is charged or not. First and second pairs of electrodes 23, 25, 27, 29, and differential amplifier 35 may very suitably be used to make this determination due to their superior noise performance.

What is claimed is:

1. An apparatus for determining the time at which a charged droplet is at a predetermined physical position comprising:

first and second electrodes disposed so that said droplet passes said electrodes in succession during use of said apparatus, said droplet inducing a charge on each said electrode as it passes; and circuitry responsive to the charges induced on the first and second electrodes for determining the time at which said droplet is at said predetermined physical position midway between said electrodes.

2. An apparatus according to claim 1 wherein said circuitry comprises: a differential amplifier, each of said first and second electrodes being connected to a respective one of the inputs to the differential amplifier; and a zero crossing detector for detecting the zero crossing between adjacent pulses of opposite sign output by said differential amplifier in response to the charges induced on the electrodes by the passing charged droplet.

3. The apparatus of claim 1, wherein said droplet passes along the sides of said electrodes without passing directly between said electrodes.

4. An apparatus for measuring the velocity of a charged ink droplet generated by an ink jet printing system comprising:

first and second spaced pairs of electrodes disposed so that said droplet passes said electrodes in succession during use of said apparatus, said droplet inducing a charge on each said electrode of the pairs as it passes; and circuitry responsive to the charges induced on the electrodes for determining the time at which said droplet is midway between the first pair of electrodes and the time at which the droplet is midway between the second pair of electrodes, the velocity measurement being provided by dividing the distance between these two midway points by the time between the times at which the droplet is at these two midway points.

5. An apparatus according to claim 4 wherein said circuitry comprises: a differential amplifier, the first electrode of each pair passed by the droplet being connected to one input of the differential amplifier, the second electrode of each pair passed by the droplet being connected to the other input of the amplifier; and a zero crossing detector for detecting the zero crossing between adjacent pulses of opposite sign output by the amplifier in response to the charges induced on the pairs of electrodes by the passing charged droplet.

6. The apparatus of claim 4, wherein said droplet passes along the sides of said electrodes without passing directly between said electrodes.

7. An apparatus for determining the time at which a charged droplet is at a predetermined physical position along a droplet path, comprising:

an array of electrodes, said array being arranged parallel to the droplet path, said droplet inducing a charge on each said electrode as it passes, each said charge occurring at a different time; and circuitry responsive to the charges induced on the array of electrodes for determining the time at which said droplet is at said predetermined physical position along said droplet path.

* * * * *